US006535086B1

(12) United States Patent
Liang et al.

(10) Patent No.: US 6,535,086 B1
(45) Date of Patent: Mar. 18, 2003

(54) DIELECTRIC TUBE LOADED METAL CAVITY RESONATORS AND FILTERS

(75) Inventors: Xiao Peng Liang, Columbia, MD (US); Todd Mahnke, Sparks, NV (US); Michael Hall, Reno, NV (US)

(73) Assignee: Allen Telecom Inc., Beachwood, OH (US)

( * ) Notice: Subject to any disclaimer, the term of this patent is extended or adjusted under 35 U.S.C. 154(b) by 0 days.

(21) Appl. No.: 09/694,183

(22) Filed: Oct. 23, 2000

(51) Int. Cl.[7] ..... H01P 7/10
(52) U.S. Cl. ..... 333/219.1; 333/222
(58) Field of Search ..... 333/219.1, 235, 333/202, 212, 209

(56) References Cited

U.S. PATENT DOCUMENTS

| | | | | |
|---|---|---|---|---|
| 2,432,093 A | | 12/1947 | Fox | 333/209 |
| 4,613,838 A | | 9/1986 | Wada et al. | 333/232 |
| 4,630,012 A | * | 12/1986 | Fuller e tal. | 333/235 |
| 5,111,170 A | * | 5/1992 | Ohya | 333/219.1 |
| 5,220,300 A | | 6/1993 | Snyder | 333/210 |
| 5,608,363 A | | 3/1997 | Cameron et al. | 333/202 |
| 5,754,083 A | | 5/1998 | Abe et al. | 333/219.1 |
| 5,764,115 A | | 6/1998 | Hattori et al. | 333/202 |
| 5,781,085 A | | 7/1998 | Harrison | 333/202 |
| 5,805,033 A | | 9/1998 | Liang et al. | 333/202 |
| 6,002,311 A | | 12/1999 | Wey et al. | 333/219.1 |
| 6,081,175 A | | 6/2000 | Duong et al. | 333/212 |
| 6,262,639 B1 | * | 7/2001 | Shu et al. | 333/202 |

FOREIGN PATENT DOCUMENTS

| | | |
|---|---|---|
| JP | 63-302601 A | 12/1988 |
| JP | 1-260901 A | 10/1989 |
| WO | WO 99/19933 | 4/1999 |

* cited by examiner

*Primary Examiner*—Robert Pascal
*Assistant Examiner*—Joseph Chang
(74) *Attorney, Agent, or Firm*—Michael Best & Friedrich, LLC

(57) ABSTRACT

Dielectric tube loaded metal cavity resonators and filters having a dielectric tube resonator extending substantially the full height of the metallic cavity are disclosed herein. The resonators and filters achieve low insertion loss in a size substantially smaller than conventional dielectric loaded resonators for equivalent quality factors. The dielectric tube resonators may be used with coaxial resonators to provide mixed resonator filter constructions.

22 Claims, 4 Drawing Sheets

DIELECTRIC TUBE LOADED METAL CAVITY RESONATORS AND FILTERS

FIELD OF THE INVENTION

This invention relates to TM01 cavity resonators and to filters achieving a low insertion loss and high Q in a small size.

BACKGROUND OF THE INVENTION

Coaxial cavity resonator filters and dielectric loaded single TE01 mode cavity resonators filters are two types of filter structures that have been widely used, especially in cellular-type telecommunications base stations, to provide high performance and high power handling. The typical quality factor (Q) of coaxial cavity resonators is from 2,000 to 8,000, while the Q of dielectric loaded TE01 mode cavity resonators varies from 12,000 to 40,000 when low loss, high dielectric constant ceramic materials are used. Usually, the cavity size of dielectric loaded TE01 mode cavity resonators is much greater than the size of the coaxial cavity resonators. To find a technology to fill the gap between these two technologies namely to produce a filter which has a Q greater than that of a coaxial cavity resonator filter, but which is of a size smaller than that of a TE01 coaxial cavity resonator has been a long time goal. It would be desirable to provide a dielectric loaded TE01 mode cavity resonator filter with a Q of 8000 to 12,000 without increasing the cavity size relative to coaxial cavity resonator technology, or to provide a similar Q with smaller size.

It would also be desirable to produce filters using both ceramic or metal disc loaded cavity resonators to achieve Qs in the ranges of 8,000 to 12,000 in a size smaller than is possible today when employing either coaxial cavity resonator and TE01 mode cavity resonator technologies.

SUMMARY OF THE INVENTION

In accordance with the present invention, an improved dielectric loaded cavity resonator filter is provided. The filter has at least one elongate dielectric tube resonator defining a clear through axial opening. The tube resonator is positioned in a conductive cavity such as a metallic cavity. The elongate dielectric tube resonator extends at least 70% of the height of the cavity and preferably extends substantially from the top to the bottom of the conductive cavity and has a length which is equal to or greater than its diameter. Means for securing the dielectric tube resonator in the cavity at each end of the tube resonator are provided. The securing means may comprise a mounting post at one end of the dielectric tube resonator. Desirably, the dielectric tube resonator defines centering formations in the clear-through axial opening and the centering formations engage the securing means at each end of the dielectric tube resonator. In a preferred form, the filter comprises a plurality of dielectric tube resonator/conductive cavities. The filter may also comprise a plurality of resonators, including at least one of the dielectric tube resonators and at least one coaxial resonator. The filter may also comprise tuning screws projecting into the dielectric tube resonators coaxial with the clear-through axial openings for adjusting the resonant frequency of the filter.

Also in accordance with the present invention, an improved dielectric loaded cavity resonator is provided comprising an enclosed housing defining a conductive cavity and an elongate cylindrical dielectric tube resonator defining a clear-through axial opening therein, the resonator being centrally located in the cavity and extending preferably substantially the full height of the cavity. In a most preferred form, the height of the dielectric tube resonator is equal to or greater than its diameter.

Further objects, features and advantages of the present invention will become apparent from the following description and drawings.

DETAILED DESCRIPTION

Figure 1:
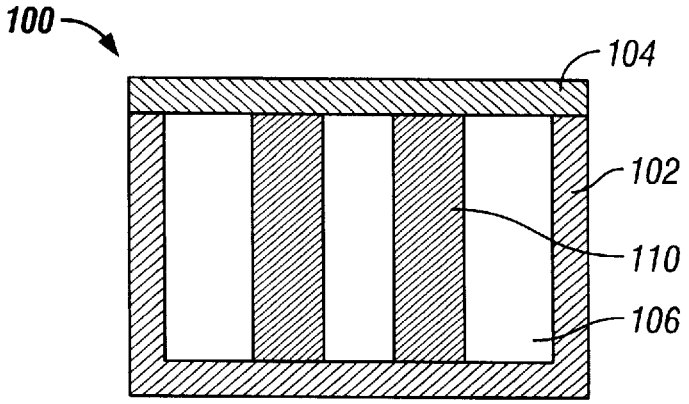
FIG. 1 is a view of a dielectric tube resonator and cavity of the present invention.

Referring now to FIG. 1, a dielectric tube resonator/cavity 100 of the present invention comprises a housing 102 and a cover 104 defining a conductive cavity such as a metallic cavity 106. Housing 102 is formed of a cast or machined metallic material, such as aluminum, or may be molded from a suitable nonconductive material, such as a plastic material, coated internally with a metallic conductive layer in a known manner. Cover 104 may be a conductive plate, or may be a plastic plate coated internally with a conductive material. Cover 104 is secured to housing 102 by screws (not shown) to define the cavity 106.

A high dielectric constant dielectric tube which functions as a dielectric tube resonator 110 is centrally positioned in the conductive cavity and extends substantially from the bottom of the cavity to the inside surface of the cover. It is spaced sufficiently at one or both ends so that it is not mechanically stressed by the housing thereby to avoid undesired distortions. The TM01 mode is the primary resonant mode. Because there is no discontinuity of the tube resonator 110 in the axial direction, the cavity resonant frequency is independent of the cavity height, a feature which makes miniaturization of filters employing such tube resonator/cavity structures possible.

In a preferred embodiment of the present invention, a dielectric tube resonator 110 may be 2.28 inches in length. It defines an internal, clear-through cylindrical axial opening having an internal diameter of 0.38 inch and an external diameter of 1.68 inches. The dielectric tube resonator material may be ceramic and has a dielectric constant of about 45. The conductive housing 102 may be generally rectangular and defines internal cavity dimensions of 3.5 by 3.5 by 2.5 inches. Cover 104 is secured to the housing by a series of screws (not shown).

Figure 2:
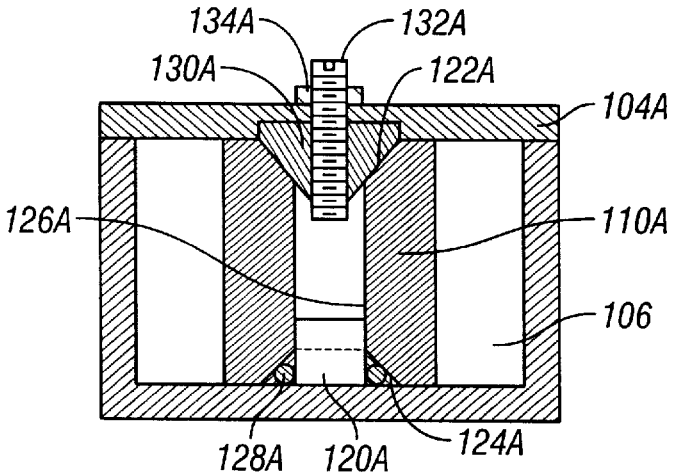
FIG. 2 is a view like that of FIG. 1 showing a mounting assembly for the dielectric tube resonator.

Referring now to FIG. 2, a typical arrangement for mounting a tube resonator 110A having a high dielectric constant of about 20 to 50 with low loss in the cavity 106 is seen to comprise a centering or mounting post 120A having a diameter substantially equal to that of the cylindrical opening in the resonator 110A. Resonator 110A defines top and bottom frustoconical internal formations 122A and 124A which may be chamfers of 45° and which are concentric with the cylindrical opening 126A of the resonator 110A.

Post 120A is secured to, and projects upwardly from, the floor of the cavity 106 and into seating engagement within the central opening 126A to center and locate the resonator 110A. A rubber O-ring 128A surrounds the post 120A and engages the frustoconical lower regions 124A of the tube resonator thereby to assist in seating and fixing the tube resonator 110A and its lower region closely adjacent to the base of the cavity. At the top of the tube resonator 110A a generally cone-shaped funnel 130A having a chamfer to match the frustoconical formation is seated in the top end formation 122A to center and locate the tube resonator 110A at its top in the cavity 106. Funnel 130A is desirably threaded centrally so that a tuning screw 132A may rotate relative thereto and may move coaxially within the central opening 126A. Tuning screw 132A defines a tool engaging formation of the outer end thereof. A locknut 134A is provided to set and maintain an adjusted position of tuning screw 132A.

A suitable dielectric tube resonator 110A is made of ceramic, is 2.28 inches in height and 1.68 inches in diameter and defines a 0.38 inch central cylindrical opening. The post 120A is of aluminum, and the funnel 130A is of aluminum. The tuning screw 132A is a threaded rod 0.20 inch in diameter and is of brass, but could be of plastic or other materials, as well. The dimensions of the conductive cavity are 3.5, by 3.5 by 2.5 inches (although the cavity may be cylindrical as well), and the frustoconical sections are at 45° to the vertical.

Figure 3:
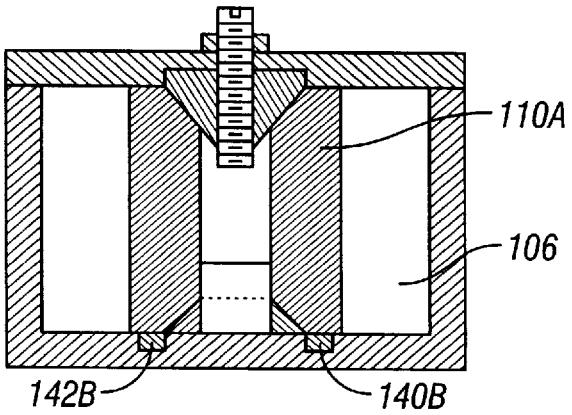
FIG. 3 is a view like that of FIG. 2 showing a modified mounting assembly for the dielectric tube resonator.

In the embodiment of FIG. 3, all of the parts, elements, and relationships may be the same as those of FIG. 2 except that the O-ring 128A is omitted and a wave-washer 140B is mounted in a shallow cylindrical slot 142B formed in the base of the cavity 106 in a location which is aligned with the lower end of the dielectric tube resonator 110A. The wave-washer 140B provides biased engagement and seating of the tube resonator 110A in the cavity 106. The wave-washer may be of metal, but can be of non-metallic material as well.

Figure 4:
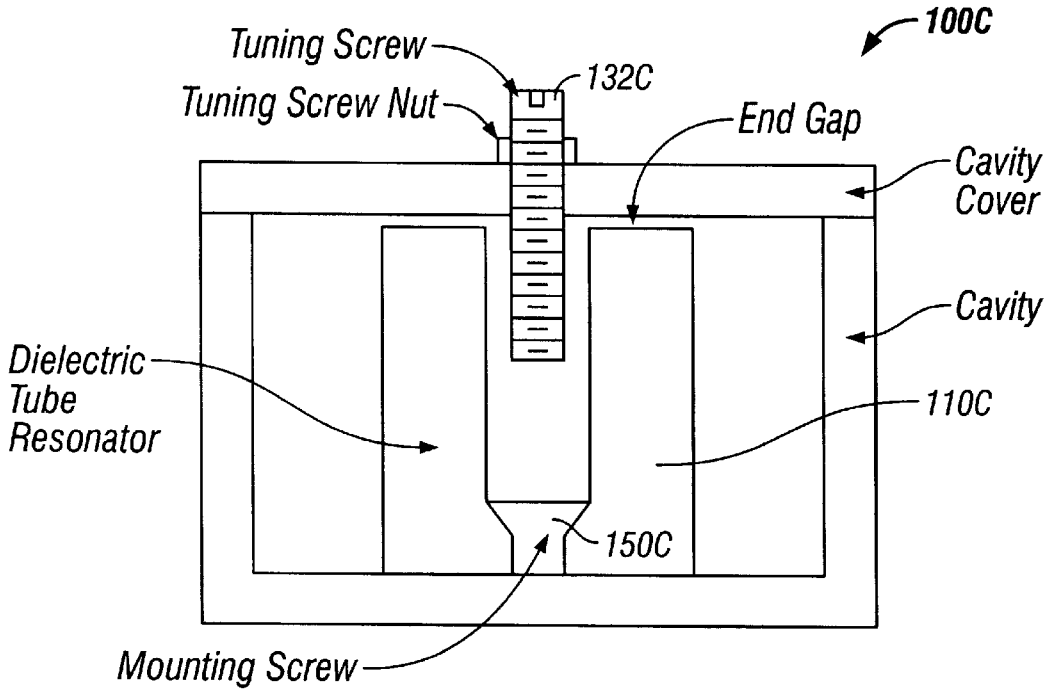
FIG. 4 is a view like that of FIG. 2 showing a further modified mounting assembly for the dielectric tube resonator.

Referring now to FIG. 4, a further dielectric tube resonator/coating 100C is shown. The housing and cover may be the same as that of FIG. 1. The dielectric tube resonator 110C may typically be of a ceramic having a dielectric constant of 45. The resonator 110C, extends from the base of the housing almost to the cover and occupies about 98% of the height of the cavity. Because the end gap is very small, the field distribution in the cavity has minor charge and the dielectric tube resonator cavity 100C therefore performs very much like the other embodiment.

The internal diameter terminates at the base of the resonator in a frustoconical configuration with the head of a threaded fastener or screw 150C which secures the resonator at the base of the housing so that it is tightly mounted against the cavity bottom wall and properly aligned with the mounting hole. There is no pressure exerted against the top of the resonator by the cover. A tuning screw 132C which is located to function as described regarding the embodiments of FIGS. 2 and 3 is provided as well.

It will be clear from the foregoing that the means for securely mounting a tube resonator in a conductive cavity which extends substantially between the top and bottom of the cavity may be provided to form a resonator/cavity assembly useful for microwave applications. The resonant frequency can be adjusted by a judiciously positioned tuning screw mounted on the cover. If, for some reason, the housing and cover dictate it, the tuning screw could enter the housing from its bottom, as through the post of FIGS. 2, 3 and 4, with like effect. Other tuning arrangements may be used as well.

Figure 5:
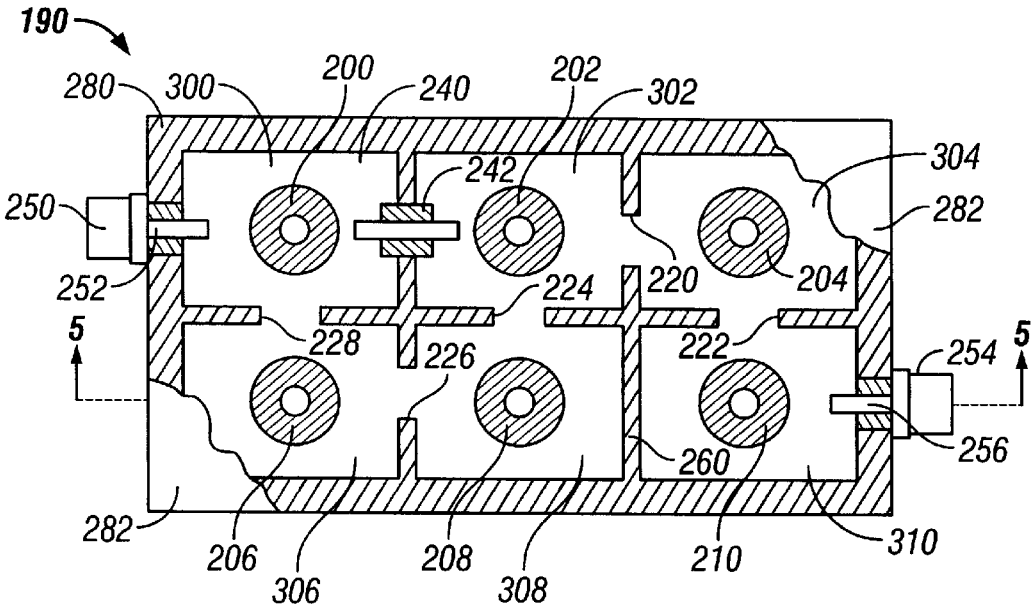
FIG. 5 is a plan view of a typical six resonator bandpass filter employing dielectric tube resonators and cavities of the type illustrated by FIGS. 1–4.
Figure 6:
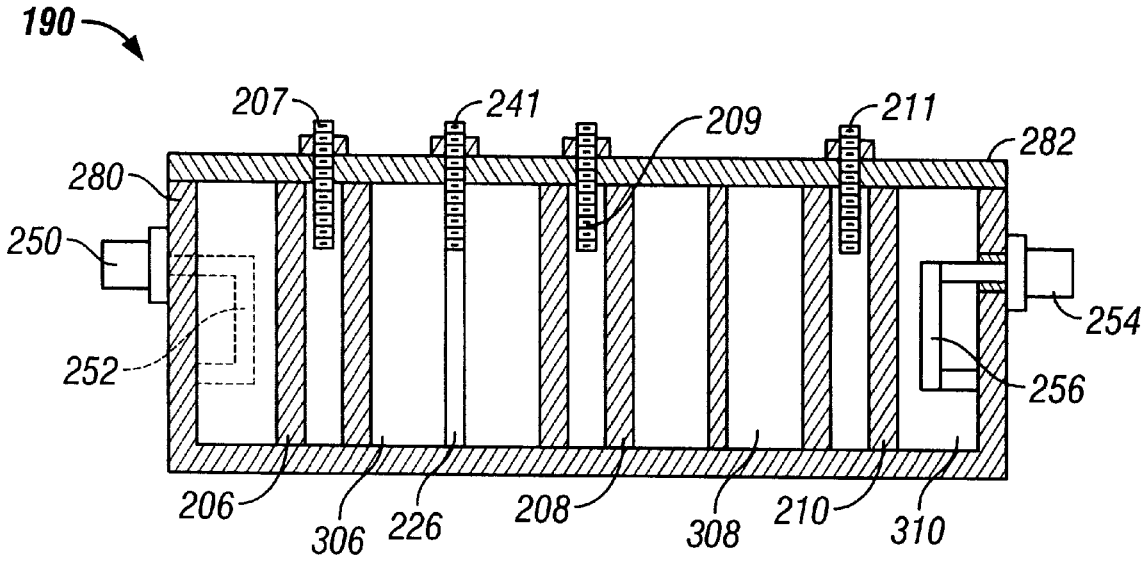
FIG. 6 is cross-sectional view of the filter of FIG. 5 taken substantially along line 5—5 of FIG. 5.

The tube resonator/cavity assemblies described are gainfully deployed in bandpass filters employing a plurality of such dielectric tube resonators, such as the six dielectric tube resonator bandpass filter of FIGS. 5 and 6.

Referring now to FIGS. 5 and 6, a six tube resonator bandpass filter 190 of the present invention comprises six dielectric tube resonator/cavities 200, 300; 202, 302; 204, 304; 206, 306; 208, 308; and 210, 310. Adjacent pairs of dielectric tube resonator/cavities are respectively coupled through adjacent irises or windows 220, 222, 224, 226, and 228 for known purposes. A variety of iris configurations may be used. Resonator/cavities 200, 300 and 202, 302 are coupled by a coupling bar 240 mounted in an electrically insulating holder 242. Isolation walls such as isolation wall 260 may be provided, consistent with filter design necessities and characteristics. The filter 190 also comprises a connector such as a threaded connector 250 having an input/output coupling loop 252 and a further threaded connector 254 also having an input/output coupling loop 256. Typically, connectors 250, 254 are coaxial connectors.

As best shown by FIG. 6, tube resonators 200, 202, 204, 206, 208 and 210 are seen to be elongated dielectric tube resonators which extend substantially from the inside bottoms of the associated conductive cavities defined by the housing 280 to the inside tops of the cavities as defined by the cover 282. The resonators may be mounted and located at their tops and bottoms as described in connection with FIGS. 1–4. Adjustable threaded tuning screws, such as tuning screws 207, 209 and 211, may be supplied for each of the respective tube resonators, and a tuning screw 241 may be provided for the coupling bar 240, as well.

In the filter of FIG. 5, the dielectric tube resonators may be 1.68 inches in outside diameter and 0.38 inch in inside diameter, and 2.38 inches in length, namely having a length which is about 1.5 times the diameter.

Figure 7:
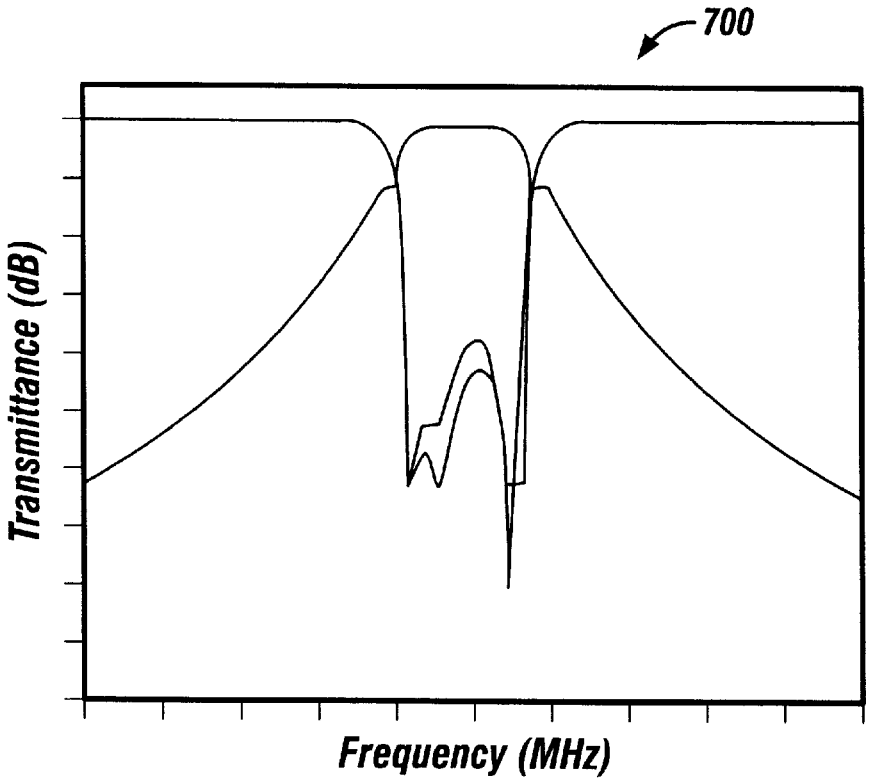
FIG. 7 is a frequency response plot of the six resonator bandpass filter of FIG. 5.
Figure 8:
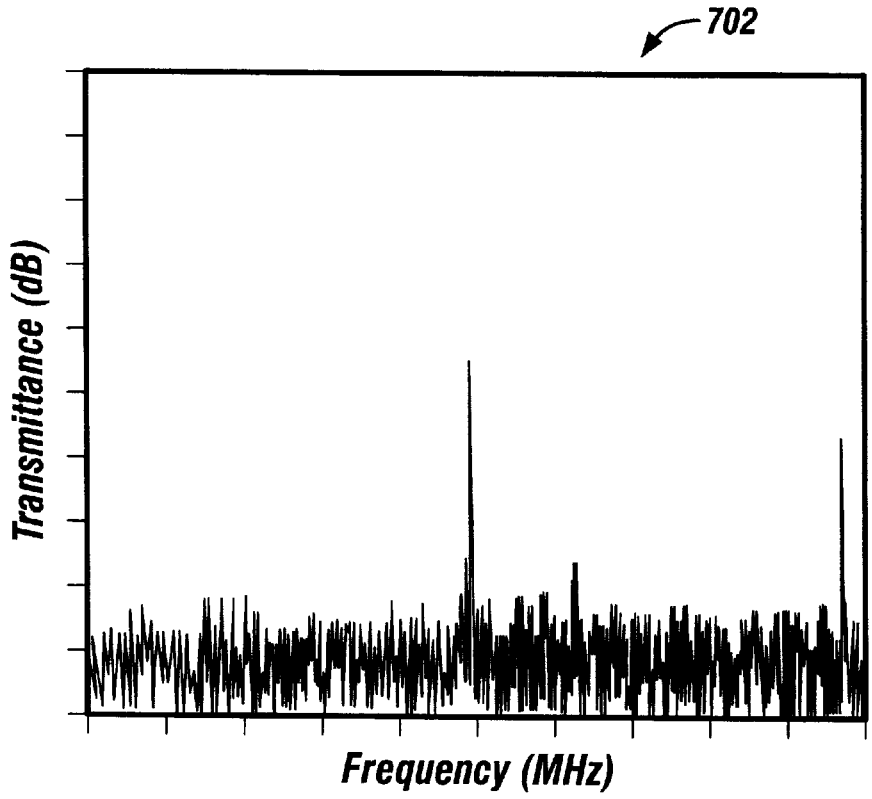
FIG. 8 is a plot showing the spurious performance of the six resonator bandpass filter of FIG. 5.

FIGS. 7 and 8 show the frequency response and spurious resonant frequencies 700, 702 of a bandpass filter constructed according to the embodiment of FIG. 5. As can be seen, the filter passes frequencies in the band between 463.5 MHz and 465 MHz. In the embodiment from which the plots of FIGS. 7 and 8 were recorded, a resonator Q of approximately 10,000 was achieved at a resonant frequency of 464 MHz. As can be seen in FIG. 8, the first spurious resonant frequency 700 occurs at 896 MHz, a ratio of 1.93 between the first spurious resonant frequency and the primary resonant frequency.

Although an exemplary filter in accordance with the present invention has been designed for use in the 450 MHz range, filters for frequencies of from 400 MHz to 3 GHz may be made as well, with advantages comparable to those of the present embodiment.

Figure 9:
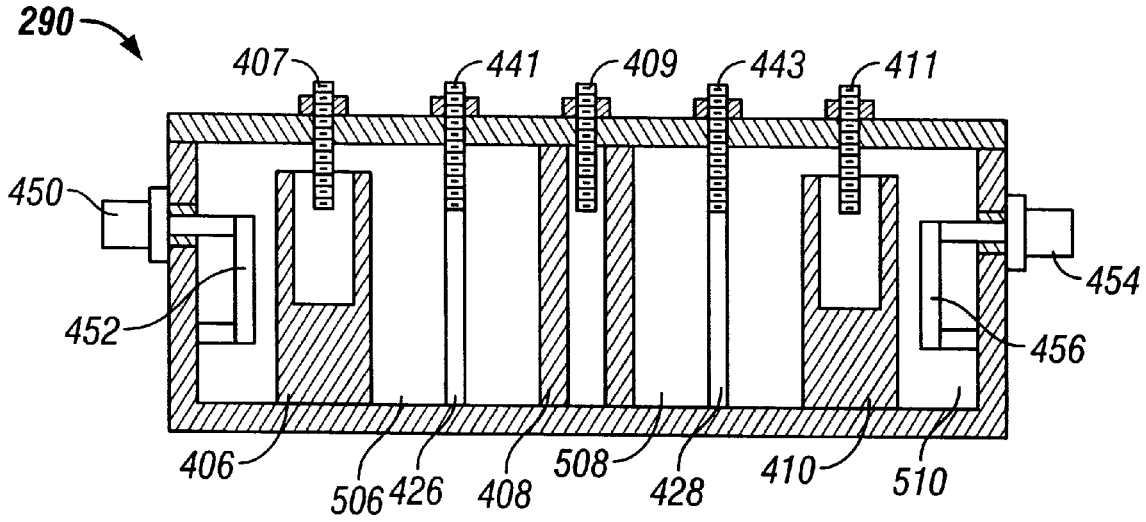
FIG. 9 is a view like FIG. 6 but showing a mixed resonator filter employing both a tube resonator/cavity of the present invention and coaxial resonators/cavities.

Because the general filter cavity design employing coaxial resonators is similar to that employing tube resonators of the present invention, it has been determined that a mixed resonator filter may be employed with advantageous results. Such a filter is shown in FIG. 9.

As there seen, a mixed, three cavity filter 290, which comprises resonators disposed in three cavities, may include two metallic coaxial resonator/cavities 406, 506 and 410, 510, and a dielectric tube resonator/conductive cavity 408, 508. Coaxial connectors 450, 454 having coupling loops 452, 456, respectively may be provided, as may be irises such as irises 426 and 428. Tuning screws 407, 441, 409, 443 and 411, like those in the embodiment of FIGS. 5 and 6, may similarly be provided for similar purposes, namely for tuning the resonators and coupling bars.

Thus, filters taking advantage of the dielectric tube resonators of the present invention and known coaxial resonators may be produced having Qs in the ranges of 8000 to 12000, but in sizes smaller than is otherwise possible currently. The adjacent and non-adjacent coupling mechanisms and frequency and coupling tuning screws are also applicable to both types of resonators, and therefore may be used in a mixed filter employing dielectric tube resonator/cavities of the present invention. The dielectric tube resonators preferably extend substantially the full heights of the cavities in which they are positioned, and minimally extend at least 70% of the height of the cavity.

Not only may the dielectric tube resonators of the present invention be used in bandpass filters of the types illustrated and described so far, and in filters used for microwave frequencies, they may be also used in a variety of other frequencies, in bandstop (notch) filters, and, among other things, in oscillator designs, as well.

Use of the dielectric tube resonator/cavity arrays of the present invention makes it possible to provide dielectric loaded resonator/cavity structures and dielectric loaded cavity resonator filters having reduced dimensions or having increased quality factors as compared to presently available dielectric loaded cavity structures and filters, all while making it possible to utilize conventional means for frequency tuning, for providing mutual and cross couplings between the resonators, and for providing input/output couplings to the resonators. Use of the dielectric tube resonator arrangements of the present invention also permit the use of mixed filters employing dielectric tube resonators and coaxial resonators with couplings among them to realize a variety of complex filter functions within a compact unit with high performance.

It will be apparent to those skilled in the art that modifications may be made in the foregoing embodiments without departing from the spirit and scope of the invention. Accordingly, it is intended that the present invention not be limited except as may be necessary in view of the appended claims.

What is claimed is:

1. A dielectric loaded cavity resonator filter having at least one elongate dielectric tube resonator defining a clear through axial opening and sized to receive a tuning screw, said resonator being positioned in a conductive cavity, said elongate dielectric tube resonator being substantially the entire height of said conductive cavity and having a length which is equal to or greater than its diameter, and means for securing said dielectric tube resonator in said cavity.

2. A dielectric loaded cavity resonator filter in accordance with claim 1, and wherein said securing means comprises securing elements at each end of said tube resonator, one of said elements comprising a mounting post at one end of said dielectric tube resonator.

3. A dielectric loaded cavity resonator filter in accordance with claim 1, and wherein said filter comprises a plurality of resonators, including at least one of said dielectric tube resonators and at least one coaxial resonator.

4. A dielectric loaded cavity resonator filter in accordance with claim 1, and wherein said filter comprises a tuning screw projecting into said dielectric tube resonator and coaxial with said clear-through axial opening for adjusting the resonant frequency of said filter.

5. A dielectric loaded cavity resonator filter in accordance with claim 1, and wherein said dielectric tube resonator extends substantially from the top to the bottom of said conductive cavity.

6. A dielectric loaded cavity resonator filter in accordance with claim 1, and wherein said filter comprises a plurality of said dielectric tube resonators.

7. A dielectric loaded cavity resonator filter in accordance with claim 6, and wherein said filter provides a plurality of tuning screws, one projecting into each of said resonators coaxially with its associated clear-through axial opening for adjusting the resonant frequency of said filter.

8. A dielectric loaded cavity resonator comprising an enclosed housing defining a conductive cavity and an elongate cylindrical dielectric tube resonator defining a clear-through axial opening having first and second ends and sized to receive a tuning screw, said resonator being centrally located in said conductive cavity by a securing mechanism positioned at least partially in one of the group of the first and second ends and the resonator extending substantially the full height of said cavity.

9. A dielectric loaded cavity resonator in accordance with claim 8, and wherein the height of said dielectric tube resonator is equal to or greater than its diameter.

10. A dielectric loaded cavity resonator having at least one elongate dielectric tube resonator defining a clear through axial opening and sized to receive a tuning screw, said resonator being positioned in a conductive cavity, said elongate dielectric tube resonator extending at least 70% of the height of said cavity and having a length which is equal to or greater than its diameter, and means for securing said dielectric tube resonator in said cavity, and wherein said dielectric tube resonator defines centering formations in the clear-through axial opening, said centering formations engaging said means for securing said dielectric tube resonator at each end of said dielectric tube resonator.

11. A dielectric loaded cavity resonator filter comprising:

a housing having a plurality of cavities, each having a height;

a first cylindrical dielectric resonator having a first end, a second end, and a longitudinal opening extending from the first end to the second end, the first cylindrical dielectric resonator positioned within one of the plurality of cavities, and having a height that is substantially the same as the height of the cavity; and a second resonator positioned within a second one of the plurality of cavities.

12. The dielectric loaded cavity resonator filter as set forth in claim 11, wherein the second resonator is a second cylindrical dielectric resonator having a first end, a second end, and a longitudinal opening extending from the first end to the second end, the second cylindrical dielectric resonator having a height that is substantially the same as the height of the housing.

13. The dielectric loaded cavity resonator filter as set forth in claim 11, wherein the second resonator is a coaxial resonator.

14. The dielectric loaded cavity resonator filter as set forth in claim 11, further comprising a fastener to position the cylindrical dielectric resonator within one of the plurality of cavities.

15. The dielectric loaded cavity resonator filter as set forth in claim 14, wherein the fastener is selected from the group consisting of a screw, a post, a centering formation, and an O-ring.

16. A dielectric resonator positioned within a housing defining a cavity having a height, the resonator comprising:

a first end having a first opening, a second end having a second opening, and a longitudinal opening extending from the first opening to the second opening;

a height that extends at least 70% of the height of the cavity; and wherein the first opening is operable to receive a tuning screw and wherein the second opening is operable to receive a fastener that substantially closes the second opening when the resonator is positioned within the housing.

17. The dielectric resonator as set forth in claim 16, wherein the securing mechanism is selected from a group consisting of a mounting post, a centering formation, and a screw.

18. The dielectric resonator as set forth in claim 16, wherein the height of the resonator is substantially the same as the height of the cavity.

19. The dielectric resonator as set forth in claim 16, wherein the resonator has substantially no discontinuities in the axial direction.

20. A dielectric load cavity resonator filter comprising:

a housing having a plurality of conductive cavitites, each having a height between opposing walls;

a cylindrical dielectric resonator having a first end and a second end defining a clear-through axial opening therebetween from the first end to the second end with the first end sized to centrally locate sadi resonator inside one of the plurality of conductive cavities with a securing mechanism at one wall of the housing;

a tuning screw at the opposing wall of the housing, said resonator second end extending to partially receive said tuning screw; and a second resonator positoned within a second one of the plurality of conductive cavities.

21. A dielectric loaded cavity resonator filter as recited in claim 20, wherein the second end of said cylindrical dielectric resonator extends substantially to the height between the opposing walls of the housing to partially receive said tuning screw from the opposing wall of the housing.

22. A dielectric loaded cavity resonator filter as recited in claim 21, wherein the second end of said cylindrical dielectric resonator extends to at least 70% of the height between the opposing walls of the housing to partially receive said tuning screw from the opposing wall of the housing.

* * * * *